United States Patent [19]

Horikawa

[11] 4,369,367

[45] Jan. 18, 1983

[54] RADIATION IMAGE INFORMATION READ OUT DEVICE

[75] Inventor: Kazuo Horikawa, Minami-ashigara, Japan

[73] Assignee: Fuji Photo Film Co., Ltd., Kanagawa, Japan

[21] Appl. No.: 168,805

[22] Filed: Jul. 11, 1980

[30] Foreign Application Priority Data

Jul. 11, 1979 [JP] Japan ..... 54-87802

[51] Int. Cl.[3] ..... G03C 5/16

[52] U.S. Cl. ..... 250/327.2

[58] Field of Search ..... 250/327.1, 337, 461 R, 250/227

[56] References Cited

U.S. PATENT DOCUMENTS 3,255,357 6/1966 Kapany et al. ..... 250/227

3,859,527 1/1975 Luckey ..... 250/337

4,127,773 11/1978 West ..... 250/461 R

*Primary Examiner*—Davis L. Willis

*Attorney, Agent, or Firm*—Gerald J. Ferguson, Jr.; Joseph J. Baker

[57] ABSTRACT

In a radiation image recording system in which a stimulable phosphor plate is first exposed to an imagewise radiation to store the energy of the radiation and record a latent image of a radiation image, the stimulable phosphor plate is then exposed to stimulating rays to emit light according to the stored energy of radiation, and the emitted light is detected to obtain an image signal, a radiation image read out device including a light source of stimulating rays and a photodetector to detect the light emitted from the stimulable phosphor plate upon stimulation thereof has a plurality of photodetectors. The plurality of photodetectors are divided into two groups. The output signal of one group is inversely amplified and the output signal of the other group is non-inversely amplified. The difference between the two output signals of the two groups is obtained by use of a differential amplifier to obtain an image signal free of quantum noise and electrical noise.

5 Claims, 13 Drawing Figures

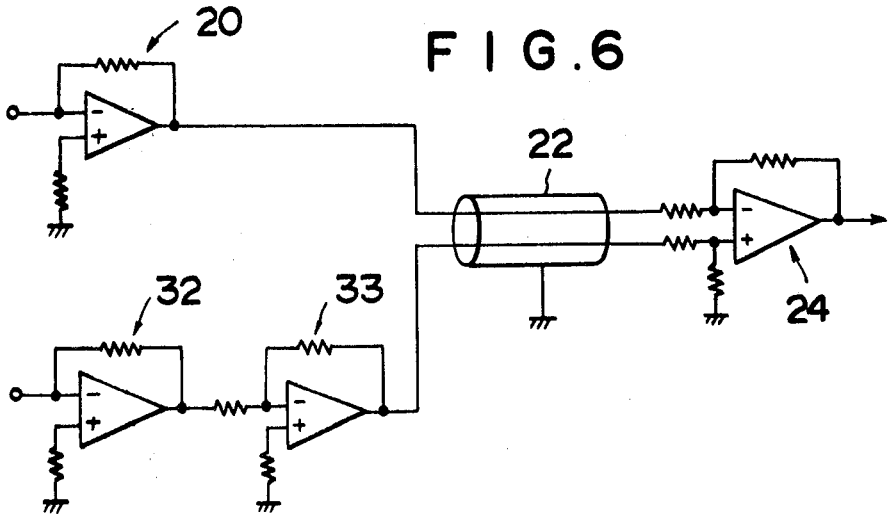
FIG.6
FIG.7
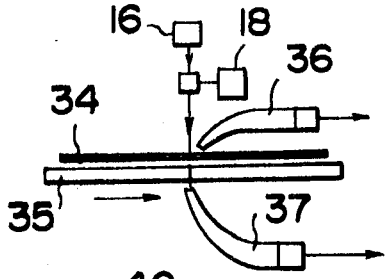
FIG.8
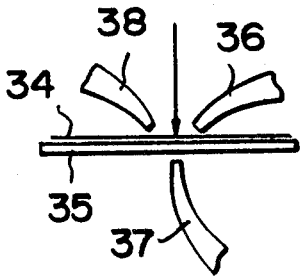
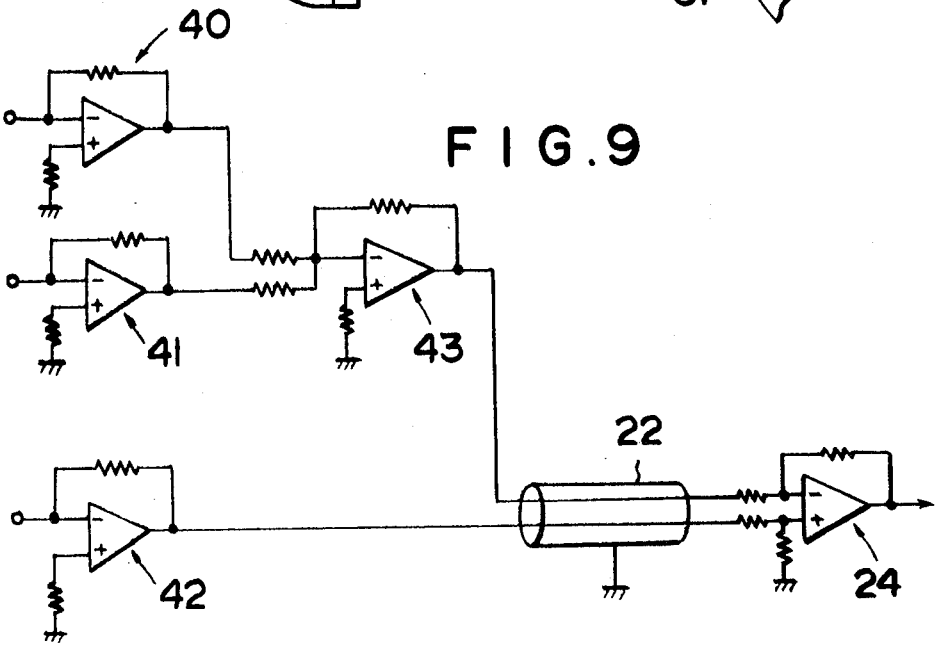
FIG.9

RADIATION IMAGE INFORMATION READ OUT DEVICE

BACKGROUND OF THE INVENTION

1. Field of the Invention

This invention relates to a radiation image read out device, and more particularly to an improvement in a read out device for reading out a radiation image recorded in a stimulable phosphor which has been exposed to imagewise radiation and stores the energy of the radiation. The read out device detects or measures the light emitted from the stimulable phosphor according to the stored energy when the stimulable phosphor is exposed to and stimulated by stimulating rays after the exposure to the imagewise radiation.

2. Description of the Prior Art

When a stimulable phosphor is exposed to a radiation like X-rays, $\alpha$-rays, $\beta$-rays, $\gamma$-rays, ultraviolet rays and so forth, a part of the energy of the radiation is stored in the phosphor. Then, when the stimulable phosphor retaining the stored energy of radiation is exposed to stimulating rays, the stimulable phosphor emits light according to the amount of energy stored therein.

A radiographic image recording system using the stimulable phosphor is known. This system is, as disclosed in U.S. Pat. No. 3,859,527, a method of recording a radiographic image finally on a photosensitive material after reading out the radiographic image recorded in a stimulable phosphor by stimulating the phosphor. In more detail, at first a stimulable phosphor is exposed to an imagewise radiation passing through an object like a human body to record a radiation image of the object. Then, the stimulable phosphor is scanned by a laser beam or the like and emits light according to the energy of radiation stored therein. The emitted light is detected by a photodetector, the output of which is used for modulating an image recording laser beam or the like to record the radiation image on a photosensitive material like a photographic film.

In the above-described method, a large semitransparent mirror inclined at 45° with respect to the optical path of the laser beam is located at a substantial distance from the stimulable phosphor plate. The stimulating rays are deflected by a galvanometer and scans the stimulable phosphor plate moving at a constant speed through the semitransparent mirror. The light emitted from the stimulable phosphor plate is reflected sideward by the semi-transparent mirror and collected by a condenser lens to enter a single photodetector. The output signal of the photodetector is sent to an analog processer after being amplified and is processed therethrough.

The light emitted from the stimulable phosphor plate is diffused and has very low intensity. Therefore, it is necessary to make the light receiving angle as large as possible to collect as much light as possible to obtain high light collecting efficiency. If the light collecting efficiency is low, the signal-to-noise ratio (S/N) is low because of the large statistical fluctuation of photons.

However, in the above-described method it is difficult to make the light receiving angle sufficiently large due to the structure of the device for reading out the image used therein, and accordingly the light collecting efficiency is as low as several percent.

Further, since the image signal obtained by converting the light emitted from the stimulable phosphor is very low in amplitude, the image signal is amplified by a pre-amplifier provided in the vicinity of the photodetector. The amplified signal is sent to the analog processer to conduct the log-conversion and gradation conversion necessary for printing on a film. The stimulable phosphor plate, a light scanning device, a photodetector and amplifiers for amplifying the minute output signals from the photodetector are normally provided within a dark box. On the other hand, the analog processer is generally located outside the box for the convenience of operation. With this arrangement, however, the distance between the amplifiers within the dark box and the analog processer becomes long and accordingly there are possibilities of picking up noise along the lines connecting therebetween which is, for example, as long as 2 m or more. Therefore, the S/N ratio is lowered in the above-described arrangement.

Further, in the image signal obtained by the photodetector is included an alternating current component known as quantum noise. Particularly when the amount of the detected photons is small, the quantum noise is not negligible. In order to eliminate the quantum noise the usual procedure is, to cut off the high frequency component by use of a low-pass filter. Though the low-pass filter is effective to eliminate the quantum noise, it is disadvantageous in that the output signal through the low-pass filter at a given moment in time contains a signal component for the previous moment in time and accordingly the degree of distinction between adjacent picture cells is lowered thereby.

As mentioned above, since the radiation image read out device measures a very minute amount of light or photons, it is liable to be subjected to influence of the quantum noise and the external electrical noise. In order to reduce the quantum noise, it is desirable to raise the light collecting efficiency to reduce the rate of the quantum noise or provide an effective electric circuit in the place of the low-pass filter to electrically remove the quantum noise. On the other hand, in order to reduce the electrical noise, it is possible to use a shielded wire. However, even if the shielded wire is used, it is difficult in practice to completely eliminate the electrical noise. Therefore, it is desirable to eliminate the noise by an electrical noise reduction means.

SUMMARY OF THE INVENTION

It is therefore the object of the present invention to provide a radiation image information read out device in which the signal-to-noise ratio (S/N) is enhanced by reducing both the quantum noise and the electrical noise.

A more specific object of the present invention is to provide a radiation image information read out device for reading out the light emitted from a stimulable phosphor stimulated by stimulating rays in which the read out signal is electrically processed to eliminate both the quantum noise and the electrical noise.

The present invention is characterized primarily in that at least two light guiding sheets having a light receiving face extending close to and along the surface of the stimulable phosphor plate are provided to effectively receive the emitted light and guide the light to the photodetectors.

The present invention is characterized secondly in that a plurality of photodetectors are divided into two groups. The output of one of the groups is inversely amplified by a pre-amplifier and the output of the other group is noninversely amplified. Then, both the outputs are transmitted to an image processing portion of an analog processer or the like where the difference between the outputs is obtained by use of a differential amplifier. In other words, the output of the photodetectors are divided into two groups and amplified separately in the opposite polarities to cancel the external electrical noise generated while the output signals are transmitted through the long wires by obtaining the difference between the separately amplified outputs. Therefore, it will be understood that the two groups may further be divided into four groups so that the finally divided groups are first added between the groups of the same polarity and then the difference is obtained between the added sums of the opposite polarities.

The present invention is further characterized in that an integrating circuit for making integration every predetermined time and a sample holding circuit for holding the integrated value for a predetermined period are provided instead of the low-pass filter.

The above-mentioned first feature is effective in reducing the rate of the quantum noise by raising the light collecting efficiency. The above-mentioned second feature is effective in eliminating the external electrical noise. The third feature is effective in eliminating the quantum noise. With these three features, it is possible to enhance the S/N ratio of the radiation image information read out device.

As the light guiding sheets used in the present invention, it is necessary to use a material which is transparent to the light to be collected and detected and is made of homogeneous material so as not to lose the light to be collected therein and further has a flat surface to conduct total reflection for the light transmitted therethrough. In order to effect the above results, the surface of the light guiding sheets must be finished sufficiently smooth.

The light guiding sheets should have a flat or straight end face to receive light emitted from the phosphor plate. The flat side face extends in parallel to the surface of the phosphor plate along the scanning line of the stimulating rays. The light guiding sheets have on the other end an annular face extending along the circular face of the photodetector. It is necessary here that the light guiding sheet should be made of a material which has a uniform thickness and a uniform width when developed so that the light transmitted therethrough may be efficiently transmitted by effective total reflection throughout the length thereof. The effective total reflection means an effective prevention of loss of light.

The shape of the light guiding sheet should be made such that the light transmitted therethrough repeats total reflection. For instance, it is not sufficient to make the curve of the side faces thereof gentle, but it is further necessary that the dimension thereof should be made to effectively provide the total reflecting surfaces so as to transmit the light throughout the length from the light receiving face to the light emanating face without loss of light.

The thickness of the light guiding sheet is important in determining the light collecting solid angle at the light receiving face faced to the point of light emission. From the viewpoint of enhancement of the light collecting efficiency, the light collecting solid angle is desired to be as large as possible. In order to make the light collecting angle large, it is useful to locate the light receiving face of the light guiding sheet close to the light emitting point or increase the thickness of the light guiding sheet.

However, when the thickness of the light guiding sheet is increased, the area of the light emanating face is also increased and accordingly the area of the light receiving face must be increased. Since there is a limit in the area of the light receiving face of the photodetectors, it is impossible to make the thickness of the light guiding sheet so large. Further, it is also impossible to make the thickness so large due to the restriction based on the process of deforming the sheet.

As the material of the light guiding sheet, transparent thermoplastic resins like acrylic resin, vinylchloride resin, polycarbonate resin, polyester resin, epoxy resin and the like or glass can be used. Among these materials, quartz glass and acrylic resin are preferable in view of the spectrum of the light emitted by the stimulable phosphor used in this invention. From the viewpoint of the process of deformation, acrylic resin and other thermoplastic resin are preferable.

The light guiding sheets as mentioned above are used for receiving the light emitted by the phosphor plate in this invention. When the stimulating rays impinge upon the stimulable phosphor plate substantially perpendicular thereto, a pair of light guiding sheets are provided in symmetric positions on both sides of the stimulating ray path. Alternatively, one light guiding sheet is located above the stimulable phosphor sheet and the other light guiding sheet is located under the phosphor sheet to measure the light emitted from the phosphor sheet at the both surfaces of the phosphor sheet. Further, it is possible to provide two light guiding sheets on the phosphor sheets and one therebeneath, or two thereon and two therebeneath using four light guiding sheets in all.

As the stimulable phosphor used for the radiation image information read out device of this invention, phosphors which emit light having a wavelength within the range of 300 to 500 nm are preferred. One example of this phosphor is, as shown in Japanese unexamined Patent Publication No. 55(1980)-12143, (corresponding to U.S. Patent Application Ser. No. 169,954 now abandoned) a phosphor represented by the formula $(Ba_{1-x-y},Mg_x,Ca_y)FX:aEu^{2+}$ wherein X is at least one of Cl and Br, x and y are numbers satisfying $0<x+y\leqq 0.6$ and $xy\neq 0$, and a is a number satisfying $10^{-6}\leqq a\leqq 5\times 10^{-2}$. Another example of this phosphor is, as shown in Japanese unexamined Publication No. 55(1980)-12145, (corresponding to U.S. Pat. No. 4,239,968) a phosphor represented by the formula $(Ba_{1-x},M^{II}_x)FX:yA$ wherein $M^{II}$ is at least one of Mg, Ca, Sr, Zn and Cd, X is at least one of Cl, Br and I, A is at least one of Eu, Tb, Ce, Tm, Dy, Pr, Ho, Nd, Yb and Er, x is a number satisfying $0\leqq x\leqq 0.6$, and y is a number satisfying $0\leqq y\leqq 0.2$. Further, as the stimulable phosphor to be used in this invention can be used ZnS:Cu,Pb; $BaO.xAl_2O_3:Eu$ wherein $0.8\leqq x\leqq 10$; and $M^{II}O.xSiO_2:A$ wherein $M^{II}$ is Mg, Ca, Sr, Zn, Cd or Ba, A is Ce, Tb, Eu, Tm, Pb, Tl, Bi or Mn, and x is a number satisfying $0.5\leqq x\leqq 2.5$, as shown in Japanese unexamined Patent Publication No. 55(1980)-12142 (corresponding to U.S. Pat. No. 4,236,078). Furthermore, as the stimulable phosphor can be used LnOX:xA wherein Ln is at least one of La, Y, Gd and Lu, X is at least one of Cl and Br, A is at least one of Ce and Tb, x is a number satisfying $0<x<0.1$, as shown in Japanese unexamined Patent Publication No. 55(1980)-12144 (corresponding to above mentioned U.S. Pat. No.

4,236,078). Among the above numerated phosphors, the rare earth activated alkaline earth metal fluorohalide phosphor is the most preferable, among which barium fluorohalides are the most preferable in view of the high intensity of emission of light.

As the stimulating rays for stimulating the stimulable phosphor to cause the phosphor to emit light is used a laser beam having high directivity. As the light source for the laser beam is preferred a laser source capable of emitting light having a wavelength within the range of 500 to 800 nm, preferably 600 to 700 nm. For example, a He-Ne laser (633 nm) and a Kr laser (647 nm) can be used. Other light sources can be used if combined with a filter which cuts out the light of the wavelength of less than 500 nm and more than 800 nm.

BRIEF DESCRIPTION OF THE DRAWING

FIG. 6 is a schematic diagram showing another example of the signal processing portion of the present invention, FIGS. 7 and 8 are side views showing other examples of the light measuring portion or emitted light detecting portion of the device of the present invention, FIG. 9 is a schematic diagram showing a signal processing circuit used in connection with the detecting portion shown in FIG. 8.

DESCRIPTION OF THE PREFERRED EMBODIMENTS

Now the present invention will be described in detail with reference to the preferred embodiments thereof referring to the accompanying drawing as briefly described above.

Figure 1:
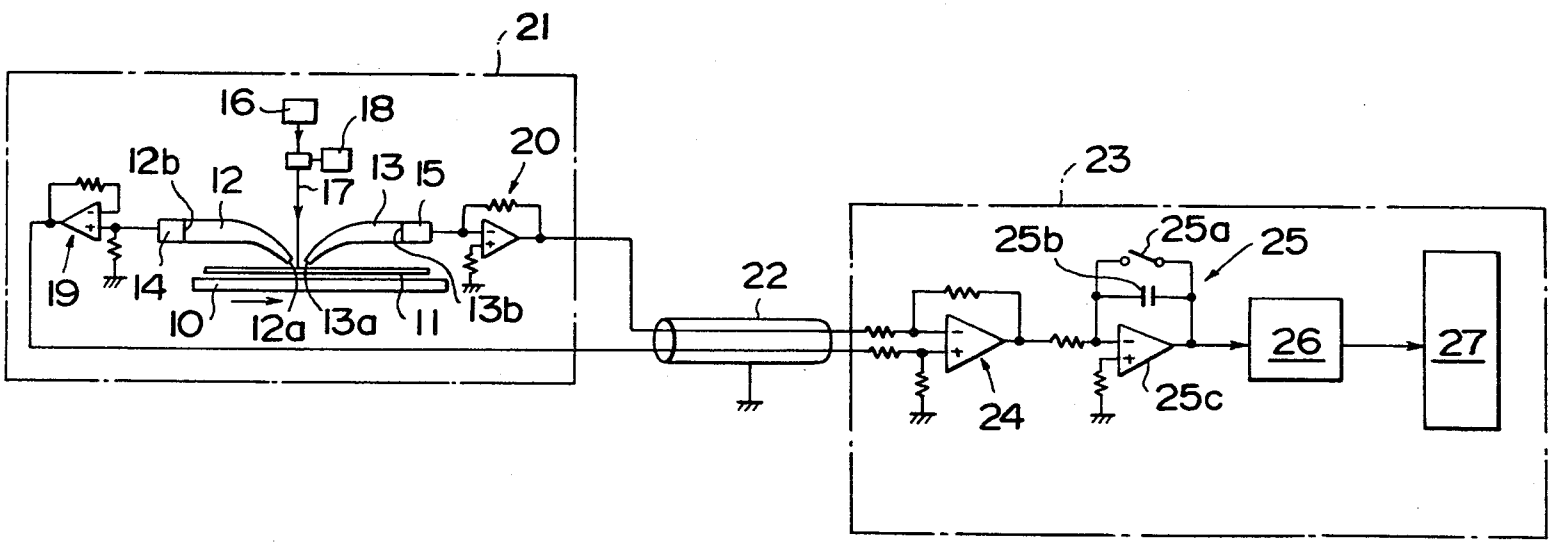
FIG. 1 is a block and schematic diagram of the radiation image information read out device in accordance with an embodiment of the present invention.

FIG. 1 shows a preferred embodiment of the present invention in which a pair of light guiding sheets are provided on a stimulable phosphor plate symmetrically with respect to the scanning line.

A rectangular stimulable phosphor plate 11 is demountably mounted on a movable holder 10 which is movable linearly. The stimulable phosphor plate 11 carries thereon a radiation image recorded by exposure thereof to a radiation through an ordinary radiation image recording step.

As the stimulable phosphor plate 11, a square plate having a size of 20 cm×20 cm having a base made of cellulose triacetate and carrying thereon a phosphor layer of a stimulable phosphor like BaFBr:Eu phosphor having a mean grain size of 10μ and a thickness after drying of 200μ applied thereon by use of nitrocellulose is used.

A pair of light guiding sheets 12 and 13 are located above the stimulable phosphor plate 11 symmetrically on both sides of a scanning line. The light receiving faces 12*a* and 13*a* of the light guiding sheets 12 and 13 are located close to the scanning line symmetrically with respect thereto. At the light emanating faces 12*b* and 13*b* of the light guiding sheets 12 and 13 remote from the light receiving faces 12*a* and 13*a* are provided photodetectors 14 and 15 in contact therewith.

Figure 2:
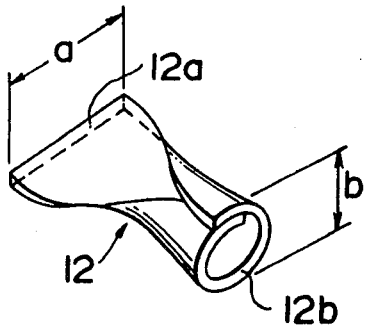
FIG. 2 is a perspective view showing an example of a light guiding sheet employed in this invention.

The details of the light guiding sheets 12 and 13 are shown in FIG. 2. The length a of the light receiving face 12*a* of the light guiding sheet 12 is made equal to or longer than the length b of the scanning line, and the length of the light emanating face 12*b* is made to be equal to the peripheral or marginal length of the circular light receiving face of the photodetector 14 so that the light emanating face 12*b* may fit when curved to a annular shape to the circular face of the photodetector 14.

As the photodetectors 14 and 15 detectors are preferred which have a large light receiving face and have a high signal-to-noise ratio (S/N) since a very minute amount of light is to be detected thereby. Photodetectors satisfying such conditions are a head-on type photomultiplier having a light receiving face at an end thereof and a channel plate of a photoelectron amplification type.

For the stimulating rays, there is used a laser beam. The laser beam 17 generated from the laser source 16 is deflected in the direction substantially parallel to one side of the stimulable phosphor plate 11 by use of a deflector 18 like a galvanometer mirror. The deflected laser beam 17 impinges upon the surface of the stimulable phosphor plate 11 at substantially a right angle with respect to the surface thereof.

If the laser beam 17 enters the photodetectors 14 and 15, the signal-to-noise ratio if lowered. Therefore, it is necessary to measure only the light emitted by the stimulable phosphor. For instance, for the stimulating rays, a red laser beam (600–700 nm) is used and for the light emitted from the phosphor plate 11, blue light (300–500 nm) is employed. When the wavelength of the stimulating rays and that of the light emitted from the phosphor plate are made different from each other, the stimulable phosphor is selected so that the phosphor emits the desirable range of wavelength.

The output signal of the photodetectors 14 and 15 is very minute, and accordingly, the signal-to-noise ratio is markedly lowered when the signal is subjected to an electrical noise. Therefore, in order to reduce the electrical noise, a non-inverse amplifier 19 is provided as a pre-amplifier in the vicinity of the photodetector 14, and an inverse amplifier 20 is provided as a pre-amplifier in the vicinity of the photodetector 15.

The above mentioned circuit elements and devices are all retained in a dark box constituting a measuring portion 21 of the radiation image information read out device. The output signals from the pre-amplifiers 19 and 20 are sent to an image processing portion 23 by way of a shielded wire 22. In the image processing portion 23 are contained a differential amplifier 24 for obtaining the difference between the output of the inverse amplifier 19 and the output of the non-inverse amplifier 20, an integrating circuit 25 consisting of a switch 25*a* which is turned ON every predetermined period by sampling pulses, an integrating capacitor 25*b* and an operational amplifier 25*c*, a sample holding circuit 26 for holding the output signal from the integrating circuit 25, and an analog processer 27 receiving the output signal from the sample holding circuit 26 and conducting gradation conversion and log conversion to record the signal on a photographic film.

Now the operation of the above mentioned embodiment will be described in detail.

The red laser beam 17 having a wavelength of 600 to 700 nm emitted from a laser source 16 is deflected by the light deflector 18 to scan a stimulable phosphor plate 11 mounted on the holder 10 and stimulate the stimulable phosphor layer of the phosphor plate 11. By the light stimulation, the stimulable phosphor layer emits light of the amount corresponding to the energy stored therein by exposure to a radiation. Therefore, the emitted light carries the radiation image information at the point where the light is emitted.

By said laser scanning beam and the movement of the stimulable phosphor plate 11 in the direction perpendicular to the scanning direction, the stimulable phosphor plate 11 is scanned two-dimensionally and emits light as it is scanned. The light emitted enters the light guiding sheets 12 and 13 through the light receiving faces 12*a* and 13*a* thereof and further enters the light receiving faces of the photodetectors 14 and 15 by way of the interior of the light guiding sheets 14 and 15 and the light emanating faces 12*b* and 13*b* thereof, and then is converted to an electric signal.

The electric signal is converted to the opposite polarities by the non-inverse amplifier 19 and the inverse amplifier 20. A pair of electric signals of the opposite polarities are input into the differential amplifier 24 of the image processing portion 23 located several meters away from the measuring portion 21 through the shielded wire 22. Since the two electric signals are converted to opposite polarity signals, the electric noise involved on the way of transmission of the signals through the shielded wire 22 is cancelled when the difference between the two signals are used as the signal.

Figure 3A:
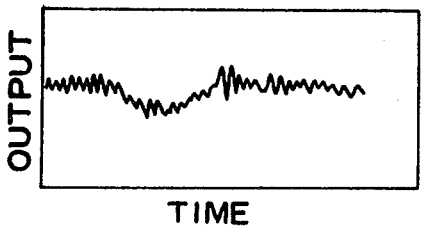
FIGS. 3A to 3C show waveforms of the signals processed in this invention.

The differential amplifier 24 obtains the difference between the two input signals of the opposite polarities and sends the result to the integrating circuit 25. The output of the differential amplifier 24 is shown in FIG. 3A. By raising the light collecting efficiency by use of the light guiding sheet, it is possible to reduce the rate of the quantum noise. However, it is impossible to eliminate the quantum noise thereby. The quantum noise is contained in the output signal of the differential amplifier 24 in the form of high frequency noise.

Figure 3B:
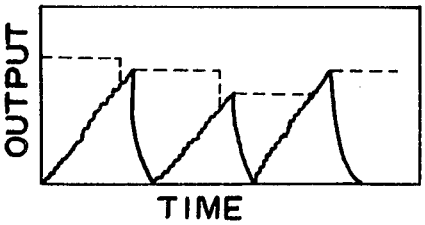
Figure 3C:
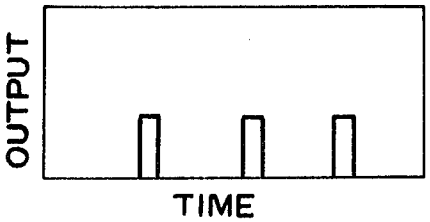

Then, by using sampling pulses of the sample holding circuit 26 as shown in FIG. 3C, the switch 25*a* of the integrator 25 is turned ON for an extremely short time in synchronization with the rise of the pulses. As a result, the output signal of the differential amplifier as shown in FIG. 3A is integrated as shown in FIG. 3B.

By the integrator 25, the output signal is integrated for every picture cell and the quantum noise is eliminated. The signal free from the quantum noise is held by the sample holding circuit 26. The signal thus held is shown by broken lines in FIG. 3B.

Thus, the signal for every picture cell is held and then sent to the analog processor 27 where it is subjected to log conversion and gradation conversion.

With the radiation image information read out from the stimulable phosphor plate, the laser beam modulator of a laser beam scanning type recording system for recording information on a photographic film is controlled. A radiation image is reproduced on the recording material like a photographic film by use of the laser beam, the amplitude of which is controlled by the radiation image information read out from the stimulable phosphor plate.

The present invention may be embodied in various other forms.

Figure 4:
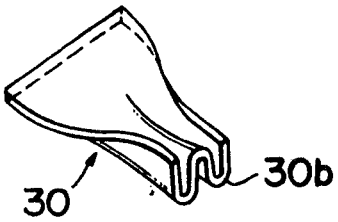
FIGS. 4 and 5 are perspective views showing other examples of the light guiding sheets.
Figure 5:
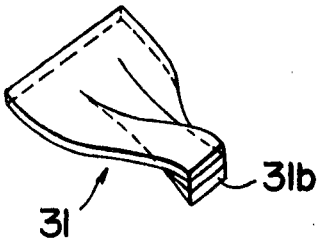

For instance, the light guiding sheets 12 and 13 may be formed into the shape as shown in FIGS. 4 and 5. In the example of FIG. 4, the light guiding sheet 30 is deformed to have a folded light emanating face 30*b*. In the example of FIG. 5, the light guiding sheet 31 is deformed and slit to have a superposed light emanating face 31*b*. In the example of FIG. 5, there is an advantage that the sheet material may not be deformed as much and accordingly the light guiding sheet can be comparatively easily made.

FIG. 6 shows an embodiment in which operational amplifiers are connected in a two step cascade connection to make the polarity inversion. In other words, inverse amplifiers 32 and 33 are connected in series to make a non-inverse amplifier. In this case, there is an advantage that the load condition for the photodetectors becomes equal for all the photodetectors inspite of the disadvantage that the number of the operational amplifiers is increased.

FIG. 7 shows an embodiment in which the light emitted from the stimulable phosphor plate 34 is detected on both surfaces of the plate 34 on a transparent holder 35. On the holder 35 is provided a light guiding sheet 36 and beneath the holder 35 is provided another light guiding sheet 37.

FIG. 8 shows another embodiment of the present invention in which a pair of light guiding sheets 36 and 38 are located on the phosphor plate 34 and a single light guiding sheet 37 is located beneath the holder 35. The output of two of the three light guiding sheets is non-inversely amplified and the other one light guiding sheet is inversely amplified.

FIG. 9 shows an example of the electric circuit for handling the signals obtained by the light detecting divice as shown in FIG. 8. These inverse amplifiers 40, 41 and 42 are used for amplifying the output signal of the photodetectors 36, 37 and 38. The output signals of the inverse amplifiers 40 and 41 are inverted and added together by an inverse adder 43 and sent to the differential amplifier 24 by way of a shielded wire 22. The output signal of the differential amplifier 24 is integrated as shown above.

Figure 10:
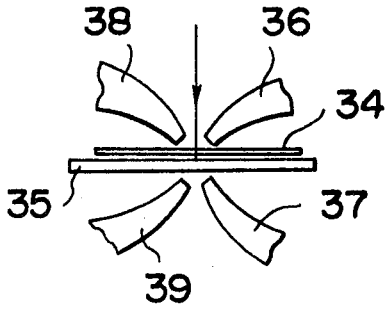
FIG. 10 is a side view showing still another example of the emitted light detecting portion of the device of the present invention.

FIG. 10 shows still another embodiment in which four light guiding sheets 36, 37, 38 and 39 are used.

Figure 11:
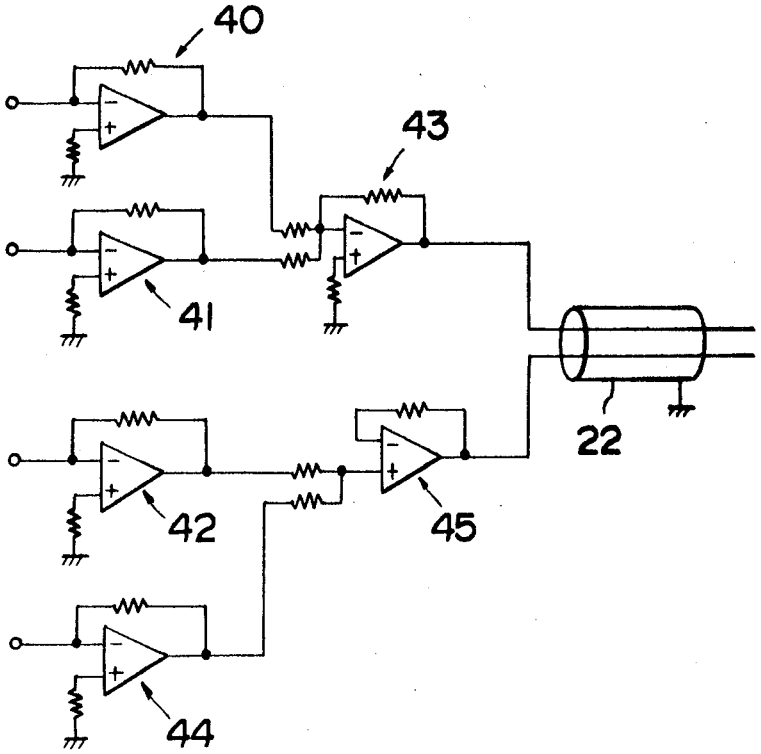
FIG. 11 is a schematic diagram showing a signal processing circuit used in connection with the detecting portion shown in FIG. 10.

FIG. 11 shows an electric circuit connected with the embodiment as shown in FIG. 10. In this case, another inverse amplifier 44 is provided and the output signals of the inverse amplifiers 44 and 42 are input into the non-inverse adder 45 to be added together. After the addition, the output signal of the inverse adder 43 is sent to the differential amplifier 24 by way of a shielded wire 22 together with the output signal of the non-inverse adder 45.

When four photodetectors are used, they are divided into two groups consisting of two photodetectors and one of the group is inversely amplified and the other group is non-inversely amplified. After the amplification, the outputs of the two groups are sent to the image processing portion 23 through the shielded wire 22, where they are first summed in each group and then the difference between the groups is obtained.

In the above described embodiment of the invention, the stimulable phosphor plate is handled in a flat form. It is possible, however, to mount the stimulable phosphor plate on a cyindrical drum to feed the phosphor plate in the direction perpendicular to the direction of deflection of the stimulating laser beam 17.

Further, in the above described embodiment the wavelength of the stimulating rays and the wavelength of the light emitted are made distinctively different from each other to prevent the lowering of the signal-to-noise ratio. However, it is possible to use a stimulable phosphor which emits light having the wavelength over a wide range covering the wavelength of the stimulating rays by using a filter to cut the light emitted having the wavelength equal to that of the stimulating rays or using photodetectors which have the spectroscopic sensitivity only in the range outside the wavelength of the stimulating rays. For instance, the light receiving faces 12*a* and 13*a* of the light guiding sheets 12 and 13 may be provided with a filter layer as said filter, or the light receiving faces of the photodetectors 14 and 15 may be provided with such a filter layer. Further, it is possible to color the light guiding sheets 12 and 13 themselves to make them work as filters. The filter layers may be provided on said faces by vacuum evaporation, for example.

Though in the above described embodiments the signals are processed by analog processing, they may be processed by digital processing by converting the output signal of the sample holding circuit 26 to a digital signal by an A/D converter and sending the digital signal to a digital processer.

Further, in place of the photographic film of silver halide type, the recording material used for recording the final visible image may be made of diazo film or electrophotographic material. Furthermore, the final image may be displayed by a CRT or the like.

The present invention will now further be described in detail with reference to examples thereof.

EXAMPLE 1

The device as shown in FIG. 1 was used with the following details. As the stimulable phosphor plate 11, there was used a BaFCl:Eu phosphor plate having a size of 20 cm×20 cm. As the laser source 16, there was used a He-Ne laser having an output power of 10 mW and a wavelength of 633 nm.

As the photodetectors 14 and 15, there were used 3 inch head-on type photomultipliers having a spectroscopic sensitivity distribution of S-11 type together with filters attached to the light receiving faces thereof. The filters were of the type in which the transmittivity to light of 633 nm was 0.1% or less and 80% to light of 400 nm. The width of the light guiding sheets 12 and 13 was 20 cm, the thickness was 5 mm and the length was 30 cm.

With the above arrangement, about 80% of the light emitted from the stimulable phosphor plate 11 was collected and about 90% thereof was received by the photodetectors 14 and 15. As a result, the signal-to-noise ratio was increased up to 3 times or more as high as that of the conventional device. Further, by use of the integrator 25 the quantum noise was substantially eliminated without deteriorating the distinction between adjacent picture cells of the image.

Furthermore, the electrical noise was reduced to 1/40 (from 4 mVpp to 0.1 mVpp) at the output of the differential amplifier 24.

I claim:

1. A radiation image information read out device for scanning a stimulable phosphor plate with a light beam of stimulating rays to cause the stimulable phosphor plate carrying radiation image information to emit light according to the radiation image information stored therein in the form of radiation energy and detecting the emitted light to read out the radiation image information comprising a plurality of light guiding sheets having at an end thereof a light input face extending along the scanning line of the stimulable phosphor plate and at the other end thereof a light output face, a plurality of photodetectors located adjacent to the light output faces of said light guiding sheets for measuring the amount of light emitted from the stimulable phosphor plate and transmitted through the light guiding sheets, said plurality of photodetectors being divided into two groups, inversion amplifier means connected with one group of said photodetectors for inversely amplifying the output thereof, non-inversion amplifier means connected with the other group of said photodetectors for non-inversely amplifying the output thereof, and a differential amplifier means connected with said inversion amplifier means and said non-inversion amplifier means for obtaining a difference between the outputs thereof.

2. A radiation image information read out device as defined in claim 1 wherein two light guiding sheets are employed and located symmetrically with respect to the scanning line on the stimulable phosphor plate where the stimulable phosphor is stimulated by the stimulating rays.

3. A radiation image information read out device as defined in claim 1 wherein more than two light guiding sheets are employed and the light guiding sheets are divided into two groups at least one of the groups includes more than one light guiding sheet, the outputs of the light guiding sheets included in one group are summed together after inversely or non-inversely amplified, and the summed outputs of the two groups are sent to said differential amplifier to obtain a difference therebetween.

4. A radiation image information read out device as defined in claim 1 further comprising an integrator connected with said differential amplifier for integrating the output signal of said differential amplifier at a predetermined interval, and a sample holding circuit for sample holding the output of the integrator.

5. A radiation image information read out device as defined in any one of claims 1 to 4 wherein one of said light guiding sheets is located above the stimulable phosphor plate to receive light emitted upward therefrom and another light guiding sheet is located under the stimulable phosphor plate to receive light emitted downward therefrom.

* * * * *